United States Patent [19]

Connelly

[11] Patent Number: 4,492,375

[45] Date of Patent: Jan. 8, 1985

[54] RESILIENT TYPE EXERCISING DEVICE WITH REMOVABLE WEIGHTS

[75] Inventor: Richard E. Connelly, Jeromesville, Ohio

[73] Assignee: Contractor Equipment Manufacturers, Inc., Ashland, Ohio

[21] Appl. No.: 408,146

[22] Filed: Aug. 16, 1982

[51] Int. Cl.[3] ..... A63B 21/00

[52] U.S. Cl. ..... 272/134; 272/136; 272/142; 272/143; 272/144; 272/140; 272/117

[58] Field of Search ..... 272/117, 136, 138, 142, 272/143, 144, 93, 134

[56] References Cited

U.S. PATENT DOCUMENTS

| | | | |
|---|---|---|---|
| D. 230,613 | 3/1974 | Coker et al. . | |
| 3,558,130 | 1/1971 | Anderson | 272/117 X |
| 3,647,209 | 3/1972 | La Lanne | 272/58 |
| 3,989,241 | 11/1976 | Ourgant | 272/142 |
| 4,072,309 | 2/1978 | Wilson | 272/136 |
| 4,286,782 | 9/1981 | Fuhrhop | 272/93 X |
| 4,317,566 | 3/1982 | Uyeda et al. | 272/143 X |

FOREIGN PATENT DOCUMENTS

| | | | |
|---|---|---|---|
| 911939 | 7/1946 | France | 272/57 R |

OTHER PUBLICATIONS

Page 18, of the Sep. 1973 issue of The Athletic Journal magazine.

*Primary Examiner*—Richard J. Apley
*Assistant Examiner*—William R. Browne
*Attorney, Agent, or Firm*—Squire, Sanders & Dempsey

[57] ABSTRACT

Physical exercise apparatus is disclosed that has a column, a sleeve slidably engaging and lockable at selected positions along the column, a lever pivotally connected to the sleeve and a removable bench connected to the column. Endless elastic bands or torsional springs may be attached to the lever and to the sleeve to provide variable resistance to pivoting of the lever or the lever may be connected to the sleeve so as to restrict pivoting of the lever.

8 Claims, 9 Drawing Figures

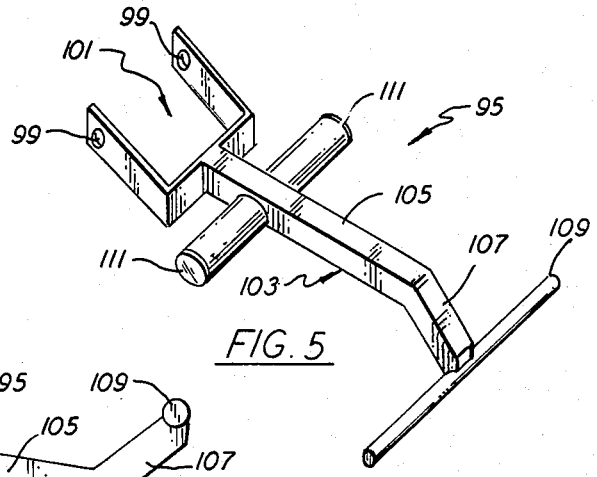
FIG. 5
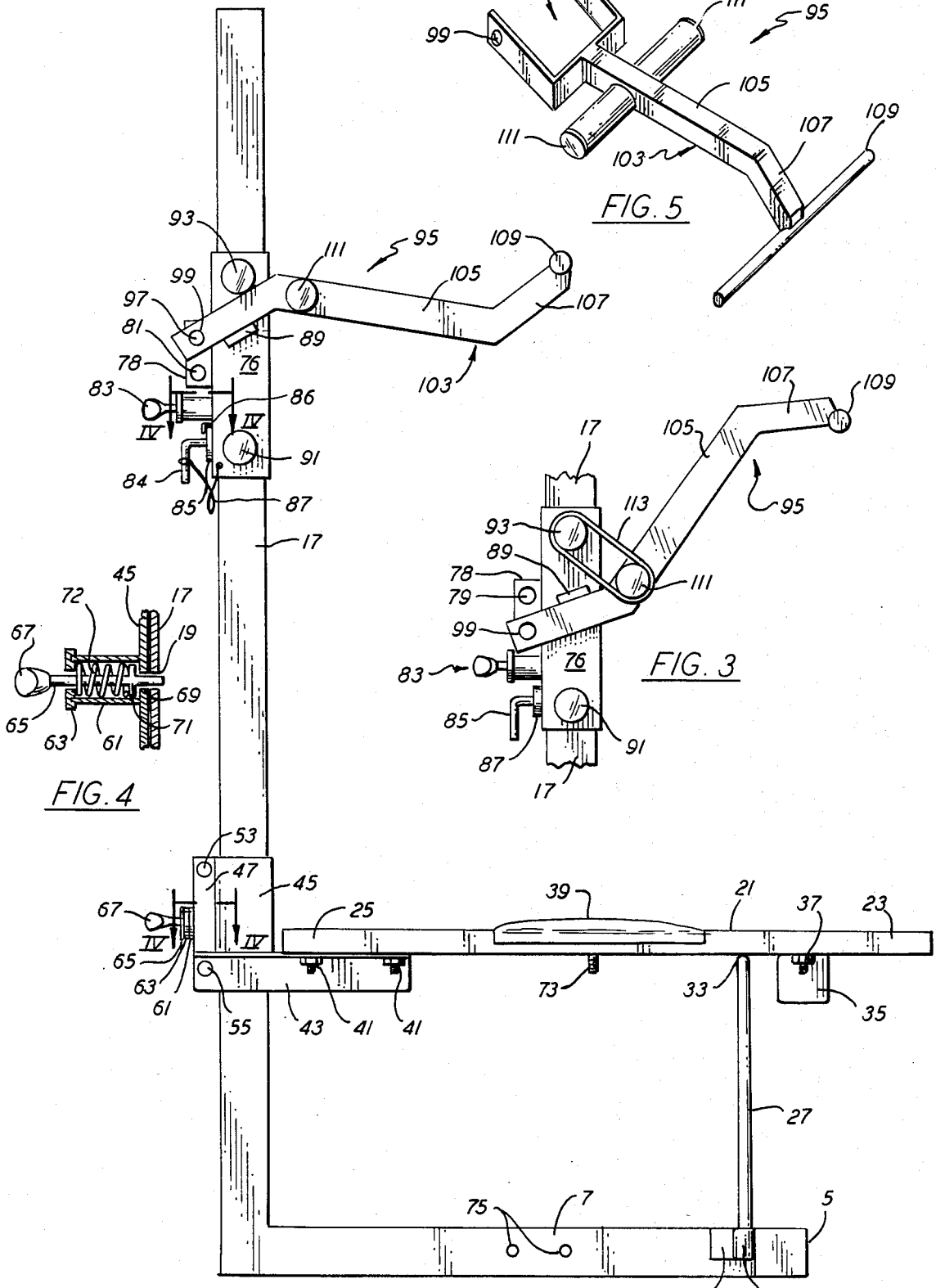
FIG. 4
FIG. 3
FIG. 2

RESILIENT TYPE EXERCISING DEVICE WITH REMOVABLE WEIGHTS

BACKGROUND OF THE INVENTION

In recent years, interest in physical fitness has dramatically increased, spawning interest in exercising and equipment aiding exercise. Although equipment to aid indoor physical exercise is available in gymnasiums, it is particularly convenient to have exercise apparatus available in the home. Typically, exercise equipment employs elements which are gripped or engaged by some part of the body and which offer resistance to the user's efforts to move them. Ideally, the amount of resistance may be varied to accomodate the strength and weight of the user. Fixed rods or bars are also of use in aiding exercises such as chin-ups, pull-ups and sit-ups. Large, expensive gymnasium-type exercise equipment is not well suited for home use by the average person. Compact, inexpensive and lightweight exercise apparatus is desirable for home use, yet the equipment must be both sturdy and versatile to justify its purchase. It is desirable that home exercise apparatus not employ weights lifted through a cable and pulley arrangement in order that excessive equipment weight may be avoided. Existing exercise equipment employing weights, cables and pulleys is either too light for effective exercise and muscle development and toning or too heavy for reasonable home installation and use.

A multi-purpose exercise device is described in U.S. Pat. No. 4,072,309 to Wilson. That device has a handled, angled lever arm. Opposite the handled end, a first pin passes through and is welded to the lever arm. Rigid fingers are welded to each end of the pin. The arm is pivotally attached to a vertical column by passing a second pin through the opposite end of both fingers and through one of a plurality of holes in a rail welded to the column. The arm may be held in a fixed position by yet another set of fingers which slip over the first pin and are then likewise pinned to rail on the column. Alternatively, elastic bands are slipped around the first pin and additional pins inserted in one of the holes in the rail to allow the arm to be pivoted against resistance. Regardless of how the Wilson device is set up, stress exerted by the user is concentrated undesirably on the welds between the lever arm and first pin. Stress exerted on the second pin tending to tear the rail from the column is not released or distributed to any other element of the device. Moreover, the lever arm is unstable with respect to moments lying in a vertical plane. An earlier patent, U.S. Pat. No. 3,989,241 to Ourgant, discloses exercising apparatus having a column and two sleeves slidable along it, one sleeve carrying a pivotally mounted lever arm and the other carrying a hanger bar with biasing means connected between the arm and bar.

SUMMARY OF THE INVENTION

In the present invention, compact, sturdy physical exercise apparatus which includes a vertical column and a generally horizontal bench is provided. In one embodiment, the column may be bolted to a wall and in another embodiment may be freestanding on a base. A lever arm extending from the column and having a handle is pivotally connected to a sleeve which slips over the column. The sleeve may be locked at a user-selected position along the column and a biasing means such as a torsion spring or an endless elastic band may be attached to the lever and sleeve. In that fashion a resistance to pivoting the lever either up or down is selectably provided. The sleeve may also be used to lock or restrain the lever against pivotal movement toward the bench so that fixed bar exercises, such as chin-ups, pull-ups and sit-ups may be performed. If fixed weight exercises are desired, conventional weights may be slipped onto the ends of the lever handle. In the embodiment of the apparatus having a base, a cable adapter allows a cable to be attached to the lever arm so that exercises equivalent to those performed with weight and pulley apparatus may be performed. The lever includes a U-shaped yoke which fits around the sleeve for pivotal connection to flanges on the sleeve. Connection of the yoke to the flanges stabilizes the lever arm against moments lying in a vertical plane. The location on the lever for attaching the biasing means is spaced from the yoke so that stress applied during exercises is not concentrated on welds in the lever arm. The sleeve and flanges tend to distribute user-induced stresses to the column relieving the pivotal bearing of the lever from some of the stress it might otherwise have to withstand. Moreover, the sleeve may be quickly adjusted in position on the column so that a sequence of different exercises may be performed without substantial interruption.

In the embodiment of the apparatus having a base, another sleeve pivotally joins one end of the bench to the column allowing that end of the bench to be raised and lowered as desired. The pivotal connection is simply removed to allow separation of the bench from the sleeve. The other end of the bench is also pivotally and removably attached to the base. In the embodiment of the apparatus without a base, the bench may be attached to the column at one of several fixed locations. In all embodiments, the bench may be removed from the column for use of the apparatus independent of the bench. The bench may also be placed on the floor or astride or athwart the base, for use with the apparatus.

A sleeve is adjusted to the desired position on the column by aligning apertures in the sleeve and the column and inserting a snugly fitting pin in them. The pin is preferably spring-loaded to aid rapid adjustment of the sleeves between different positions on the column corresponding to its apertures. A safety means pins the lever arm sleeve to the column to prevent inadvertent movement of the sleeve on the column.

BRIEF DESCRIPTION OF THE DRAWINGS

FIG. 2 is a side view of an embodiment of physical exercise apparatus according to the invention.

FIG. 3 is a side view of a portion of an embodiment of physical exercise apparatus according to the invention.

FIG. 4 is a sectional view of an embodiment of a locking means according to the invention.

FIG. 5 is a perspective view of an embodiment of a lever according to the invention.

DETAILED DESCRIPTION OF PREFERRED EMBODIMENTS

Figure 1:
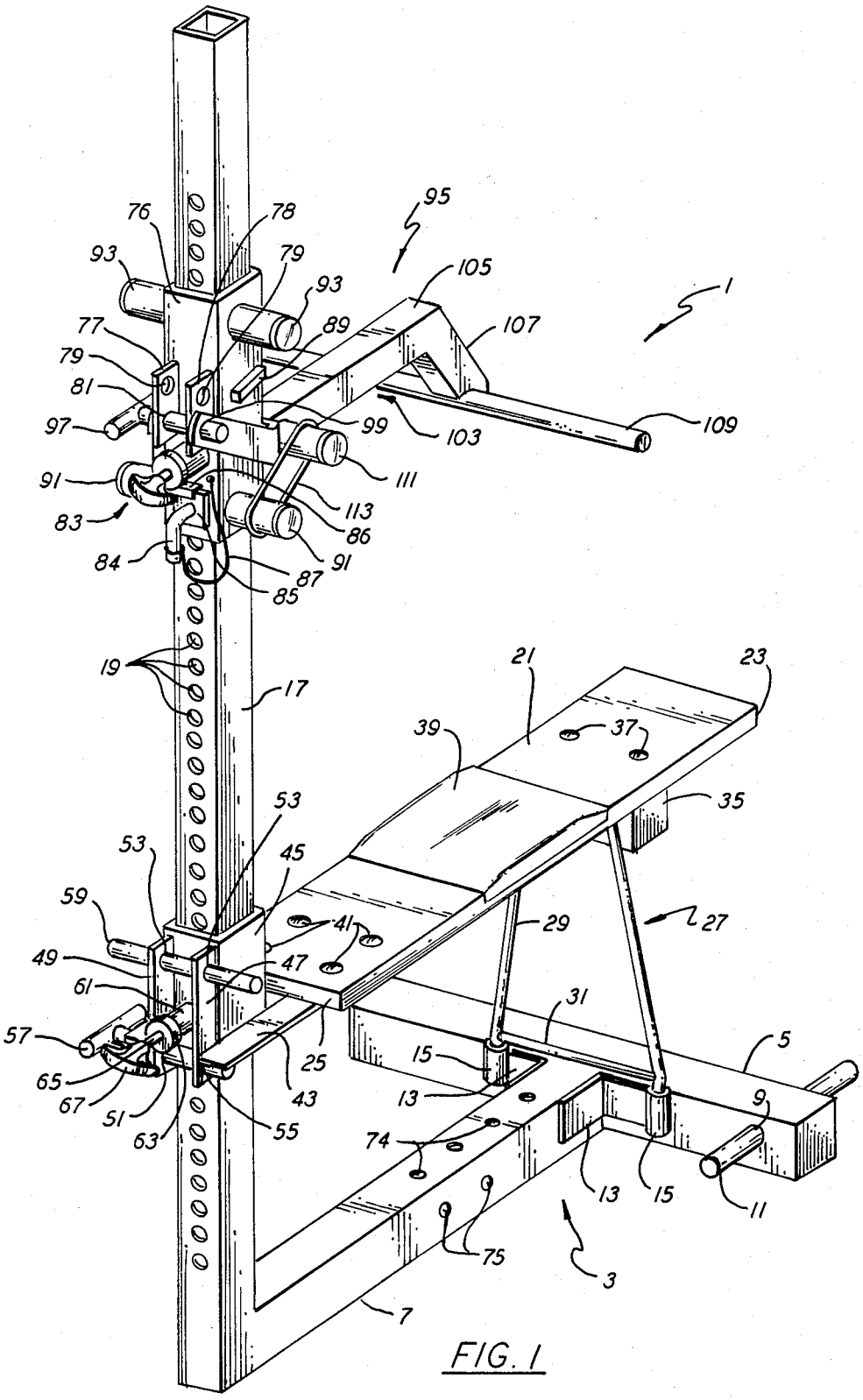
FIG. 1 is a perspective view of an embodiment of physical exercise apparatus according to the invention.

The preferred embodiments of the physical exercise apparatus according to the invention are intended to be installed in a home on an essentially horizontal floor for the embodiment with a base or on an essentially vertical wall for the embodiment without a base. In those installations, many of the elements of the preferred embodiments described here are generally parallel to the floor and others are generally perpendicular to it. For ease of reference, elements which would be generally parallel to the floor in such installations are referred to here as transverse, whereas those generally perpendicular to the floor are referred to here as longitudinal. Likewise, dimensions measured in one of these directions are referred to here as transverse or longitudinal. In all the drawing figures referred to in this description, like elements are given the same reference numerals.

A perspective view of a preferred embodiment of physical exercise apparatus having a base is shown in FIG. 1. An exercise apparatus 1 includes a transverse base 3 having two base sections 5 and 7, preferably formed from identical cross section tubing having a planar side for floor contact. Preferably the tubing is formed of steel having a rectangular or square cross section. Base sections 5 and 7 are joined preferably by welding, so as to have a common transverse flat surface. Base sections 5 and 7 preferably form transversely the shape of the letter T. Both ends of base section 5 are free whereas one end of base section 7 joins at the center of section 5. Preferably, a hole 9 is bored near one end of base section 5 into which a rod 11 may be inserted for aiding the performance of various exercises such as extended sit-up exercises. In each inside corner of the junction of base sections 5 and 7, an L-shaped bracket 13 is joined along its sides, preferably by welding, to both sections 5 and 7. The ends of brackets 13 near each free end of base section 5 each include a hollow cylindrical receptacle 15 for receiving a rod or tube.

A longitudinal column 17, preferably of the same cross section as sections 5 and 7, is joined, preferably by welding, to the end of section 7 opposite its junction with section 5. Column 17 contains a plurality of longitudinally aligned transverse apertures 19 on a flat surface opposite the side of column 17 attached to base 3. A rectangular bench 21, preferably wooden, having opposing ends 23 and 25, is transversely disposed, spaced from base 3 and joined to column 17. Bench 21 is pivotally supported on base 3 near end 23 by support means. An embodiment of a support means includes a frame 27, preferably tubular, generally in the form of a letter A with a flattened top. The frame includes generally longitudinal legs 29 having a transverse brace 31 near their ends and a transverse top section 33 which bears against bench 21 near end 23. The ends of legs 29 are spaced to be received by receptacles 15. A hollow box 35 is bolted to the side of bench 21 adjacent to frame section, i.e., the underside, by bolts 37 at a location between bench end 23 and frame 27. Bolts 37 are preferably countersunk on the opposing surface of bench 21. As end 25 of bench 21 is tilted, the separation between box 35 and frame 27 changes, box 35 acting as a limit on tilt angle when it contacts frame 27. So long as end 25 of bench 21 is prevented from slipping, frame 27 provides an adequate pivotal support means for bench 21. Near its center, bench 21 preferably includes a padded seat 39 for the comfort of the user.

End 25 of bench 21 is bolted by bolts 41 to a pair of angle brackets 43 disposed on the underside of bench 21. Bolts 41 are preferably countersunk into the same surface of bench 21 as are bolts 37. A sleeve 45 is disposed on and slidably engages column 17. Preferably, sleeve 45 includes Teflon bearings (not shown) disposed on its inside surfaces to assist in its sliding on column 17. Longitudinal flanges 47 and 49 are attached, preferably by welding, to sleeve 45 at the edges of the surface of sleeve 45 opposing the surface of column 17 containing apertures 19. Flanges 47 and 49 contain two pairs of aligned flange bores 51 and 53, only one of pair 51 being visible in FIG. 1. Angle brackets 43 protrude from beneath bench 21 and straddle sleeve 45. Brackets 43 have a pair of aligned bores 55, only one of which is visible in FIG. 1, alignable with flange bores 51 and 53. In FIG. 1, bores 51 and 55 are shown aligned and a T-handled key 57 is shown passing through them. Key 57 is of circular cross section, as are bores 51, 53 and 55, so that brackets 43 can pivot around key 57 as sleeve 45 slides along column 17. In FIG. 1, a removable rod 59, useful in performing certain exercises, is shown inserted through flange bores 53. A locking means for locking sleeve 45 in place at various locations along column 17 is installed on sleeve 45. The embodiment of a locking means shown comprises a cylinder 61 joined, e.g., by welding, to sleeve 45, and having a cap 63 joined to it, permanently or by screw threads. A pin means for engaging aligned apertures in sleeve 45 and column 17 includes a pin 65 and a T handle 67 at one of its ends. The mechanism of the embodiment of the locking means is most clearly shown in FIG. 4 which shows a cross section of the embodiment. Sleeve 45 has an aperture 69 which is alignable with any of the apertures 19 in column 17. When aperture 69 is aligned with one of apertures 19, as shown in FIG. 4, pin 65 may protrude through and engage the apertures. A collar 71 on pin 65 limits the protrusion of pin 65 into the aligned apertures and acts as a bearing surface for an urging means for urging pin 65 into the aligned apertures. In FIG. 4, the urging means, which is part of the pin means, is a helical spring 72 shown coaxially disposed about pin 65. The opposite end of spring 72 bears on the inside of cap 63. Thus, on withdrawal of pin 65 by pulling on handle 67, sleeve 45 may be adjusted along column 17. When the desired location is attained, the handle is released so that pin 65 engages and protrudes through aperture 67 on sleeve 45 and one of apertures 19, thereby locking sleeve 45 in position.

Adjustment of the angle of bench 21 with respect to base 3 is simply accomplished by unlocking the locking means, for example, by withdrawing handle 67, sliding sleeve 45 and releasing the handle when the desired position is attained. Support 27 supports bench 21 and allows it to slide toward or away from column 17, as necessary, to permit the angular adjustment of the bench, i.e., allows it to pivot around frame top 33. If present, rod 59 conveniently provides a handle for lifting or lowering sleeve 45 while handle 67 is retracted. As earlier noted, key 57 provides the pivot for end 25 of bench 21. The T handle on key 57 aids withdrawal of the key either to shift the pivot point between flange bores 51 and 53 or to remove bench 21 entirely. As FIG. 1 makes clear, removal of key 57 allows angle brackets 43 to be slipped off sleeve 45 and bench 21 to be lifted away from the apparatus. Bench 21 is installed by the same procedure in reverse order.

Preferably, a pair of shafts or bolts 73 are attached to bench 21 and protrude from its underside at approximately the midpoint between its ends 23 and 25. Only one of the shafts is visible in FIG. 2. As shown in FIG. 1, section 7 of base 3 preferably includes a series of longitudinal holes 74, sized and spaced to receive shafts 73. Section 7 also contains transverse holes 75 sized to receive rod 59. When rod 59 is in place through holes 75, an exerciser may hook his feet beneath the rod to assist in performing exercises requiring substantial exertion. The longitudinal dimension of box 35 and angle brackets 43 are preferably the same as the longitudinal dimension of section 7. With this preferred design, bench 21 can be removed as just described and placed athwart section 7 with shafts 73 engaging holes 74. If the base is resting on a planar surface, box 35 and angle brackets 43 will support the ends of bench 21 while base section 7 supports its midpoint. In other words, bench 21 will be stably held in place across base section 7 for convenience and safety in performing standing exercises as explained elsewhere in this description.

Another sleeve 76 having the same shape in cross section as column 17 is disposed on and slidably engages column 17. Sleeve 76 preferably includes Teflon bearings (not shown) disposed on its inside surface to assist its sliding on column 17. Sleeve 76 includes longitudinal flanges 77 and 78 attached, preferably by welding, at the edges of the surface of sleeve 76 opposing the surface of column 17 containing apertures 19. Flanges 77 and 78 contain opposed, aligned flange bores 79 and 81, only one of flange bores 81 being visible in FIG. 1. Sleeve 76 also includes locking means for locking it into place at a desired position along column 17. Preferably, the embodiment of the locking means comprises a cylinder and handle assembly designated 83 which is identical to the embodiment of the locking means described for sleeve 45, so that no further description is necessary. Sleeve 76 also incorporates a safety means which includes a rod 84, bent approximately at a right angle, and having a collar 85 attached to it, and an overhanging lip 86 welded to sleeve 76. Preferably, a lanyard 87 connects rod 84 to sleeve 76. These parts are shown in greater detail in FIG. 6. Rod 84 passes through aligned apertures in sleeve 76 and column 17 and may be rotated. Collar 85 limits the depth of insertion of rod 84. Overhanging lip 86 blocks collar 85 so that rod 84 generally may not be withdrawn. Collar 85 is shown as circular with an asymmetrical portion where material has been removed outside a chord of the circle so that a flat portion 85*a* is formed. Flat portion 85*a* is dimensioned so as to cooperate with lip 86 and prevent rod 84 from being withdrawn except when flat 85*a* and lip 86 are properly aligned through the rotation of rod 84. Lanyard 87 prevents rod 84 from falling to the floor, so that it is always handy for insertion in sleeve 76 and column 17. Sleeve 76 contains an additional aperture, not visible in FIG. 6, which aligns with one of apertures 19 when locking means 83 is engaging another of apertures 19. When the safety means is engaged, rod 84 protrudes through the aperture in sleeve 76 which is not visible and through the aligned aperture 19 into column 17 as far as collar 85 permits. When rod 84 is in place, sleeve 76 cannot be moved. Thus, the safety means provides an extra measure of safety in the unlikely event the shaft in the locking means should fail. In addition, the safety mechanism prevent inadvertent adjustments of sleeve 76 should the locking means be accidentally or prematurely unlocked.

An important advantage of the sleeve adjustment, locking and safety means of the present invention is the ability to reposition a sleeve quickly during a sequence of exercises. One object of exercise routines is to achieve and maintain throughout the routine a target heartbeat rate. Maintenance of the target rate requires that there be no substantial interruption between a particular exercise and the next one. In contrast to other in-home exercise apparatus, the sleeve adjustment provided for in the present invention permits rapid and accurate positioning and repositioning of the bench and/or lever so that an essentially continuous sequence of exercises may be performed.

In the embodiments of the apparatus shown in FIGS. 1 and 2, on opposite sides of sleeve 76, which are adjacent to the side to which flanges 77 and 78 are attached, stop means 89 are attached, preferably by welding. Only one of stop means 89 is visible in FIGS. 1 and 2, in the form of a bar, of rectangular cross section, attached at an angle lying between the longitudinal and transverse directions. Another stop means element is symmetrically located on the opposite side of sleeve 76. Sleeve 76 also contains securing means for securing biasing means. In FIGS. 1 and 2, these securing means appear in the form of pairs of opposing cylinders 91 and 93, disposed at longitudinally opposing ends of sleeve 76. Cylinders 91 and 93 are preferably closed on their ends and may be solid or hollow and are preferably welded to sleeve 76.

In FIGS. 1 and 2, a lever 95 is shown pivotally attached to flanges 77 and 78 by a pivot means. The pivot means includes a T handled shaft 97 of circular cross section which passes through a pair of the preferably circular, coaxial flange bores 79 and 81, and also through a pair of preferably circular coaxial yoke bores 99 in lever 95. Bores 99 are alignable with flange bores 79 and 81 and are preferably of the same size. Only one of bores 99 is visible in FIGS. 1 and 2, but both are visible in the perspective view of lever 95 in FIG. 5. As most clearly seen in FIG. 5, lever 95 includes a U-shaped yoke 101, having angular rather than curved corners, which is attached centrally at the base of the U to an arm 103. Arm 103 and yoke 101 are preferably welded together. Yoke 101 has sufficient width to straddle sleeve 76. As previously noted, the straddling portions contain bores 99 which are coaxial and alignable with flange bores 79 and 81 of flanges 77 and 78. Arm 103 includes two elongated portions, arm portion 105 being joined at one end to yoke 101 and at its other end to arm portion 107. The long axes of portions 105 and 107 intersect in arm 95 forming an obtuse angle between them. As shown in FIGS. 1 and 2, when lever 95 is mounted on sleeve 76, it extends over base 3 and the central, longitudinal axis of column 17 lies in the plane formed by the long axis of elongated arm portions 105 and 107. At the end of arm portion 107 is attached a handle 109 which is transverse when lever 95 is installed on sleeve 76. On arm portion 105, spaced from the junction of yoke 101 and arm 103, attachment means for attaching biasing means are joined to arm 103. In the figures, an embodiment of a securing means for securing biasing means is shown in the form of opposing cylinders 111, which are transverse when lever 95 is installed on sleeve 76. Cylinders 111 preferably transversely extend beyond the maximum transverse dimension of yoke 101.

In FIGS. 1, 2 and 3, various alternative attachments of lever 95 to sleeve 76 are shown. In FIG. 1, lever 95 is shown pivotally attached to sleeve 76, through shaft 97 which passes through lower flange bores 81 and bores 99 in yoke 101. Biasing means for providing resistance to pivotal movement of lever 95 are secured to securing means on sleeve 76 and the lever. In FIG. 1, an embodiment of the biasing means is shown as an endless elastic cord 113 which is looped over cylinder 111 and cylinder 91, cylinder 91 on sleeve 76 being the securing means on that sleeve lying nearer base 3. Only one elastic cord is visible in FIG. 1, but it is understood that cords are symmetrically placed on each side of sleeve 76 and that more than one cord may be used on each side of the sleeve to increase the resistance to pivoting. Commercially available elastic cords used in the aircraft industry having a latex interior with a woven covering and various spring constants are suitable for use with the apparatus. As FIG. 1 makes clear, arm 103 and yoke 101 are preferably angularly joined so that portion 105 of arm 103 is transverse when the set-up of FIG. 1 is established. Yoke 101, in FIG. 1, is drawn by the biasing means to rest against sleeve 76. The exerciser pushes on handle 109 to pivot lever 95 away from base 3, the pivotal motion being increasingly resisted by elastic cords 113 as those cords are extended.

In FIG. 3, a set-up of the embodiment of the apparatus is depicted in which resistance to pivotal motion of lever 95 toward base 3 is presented. Cords 113 are removed from cylinders 91 and looped over cylinders 93 instead. Cylinders 93 are disposed at the opposite end of sleeve 76 from cylinders 91. In this configuration there is resistance to pivoting of lever 95 toward base 3, opposite in direction to the resistance previously described. Lever 95 is drawn toward cylinder 93 by cords 113, but is restrained by stop 89.

In yet another set-up, which is shown in FIG. 2, elastic cords are not involved. To achieve that set-up from those of FIG. 1 or 3, cords 113 are removed and shaft 97 is withdrawn so that lever 95 is released. Lever 95 is then rotated 180° about the axis of arm portion 105 and yoke 101 replaced astride sleeve 73, and between cylinders 93 and stops 89. Yoke bores 99 are aligned with flange bores 79 and shaft 97 slipped through them. If no force is applied, yoke 101 will rest on stop 89 which restricts lever 95 in pivoting toward base 3. As a result, an exerciser may use handle 109 as a stationary bar to perform pull-up and chin-up exercises. As those skilled in the art will appreciate, the location of flange bores 79 and 81, 99 and stops 89, the mounting angle of stop 89 and the angle between yoke 101 and arm portion 105 are interrelated and must be coordinated in order to enable the achievement of the set-ups just described.

The apparatus may be adapted for use with conventional lifting weights by placing adapters (not shown) over the ends of handle 109 which are sized to engage the central hole in those weights. In addition, T handle adapters (not shown) may be slipped over the ends of handle 109 to provide hand grips perpendicular to handle 109. Grips in that direction aid in certain exercises such as side arm pull-ups and dips.

The angle in arm 103 is advantageously used in changing from the set-up of FIG. 1 to that of FIG. 2. The angle results in handle 109 being spaced farther from base 3 in the latter configuration which is desirable since there the exerciser is likely to be standing, whereas the exerciser may be sitting to use the apparatus in the other set-ups. The increased elevation may avoid the need to adjust the position of sleeve 76 on column 17 when a change in exercises is made. For some exercises, bench 21 may be in the way. It is desirable not only to remove it, but to place it across base section 7, in the manner disclosed elsewhere in this description, so that the user may stand on it when doing the stand-up exercising. Such use of the bench provides additional protection against tipping of the apparatus when the user is pivoting the lever away from the base.

Figure 7:
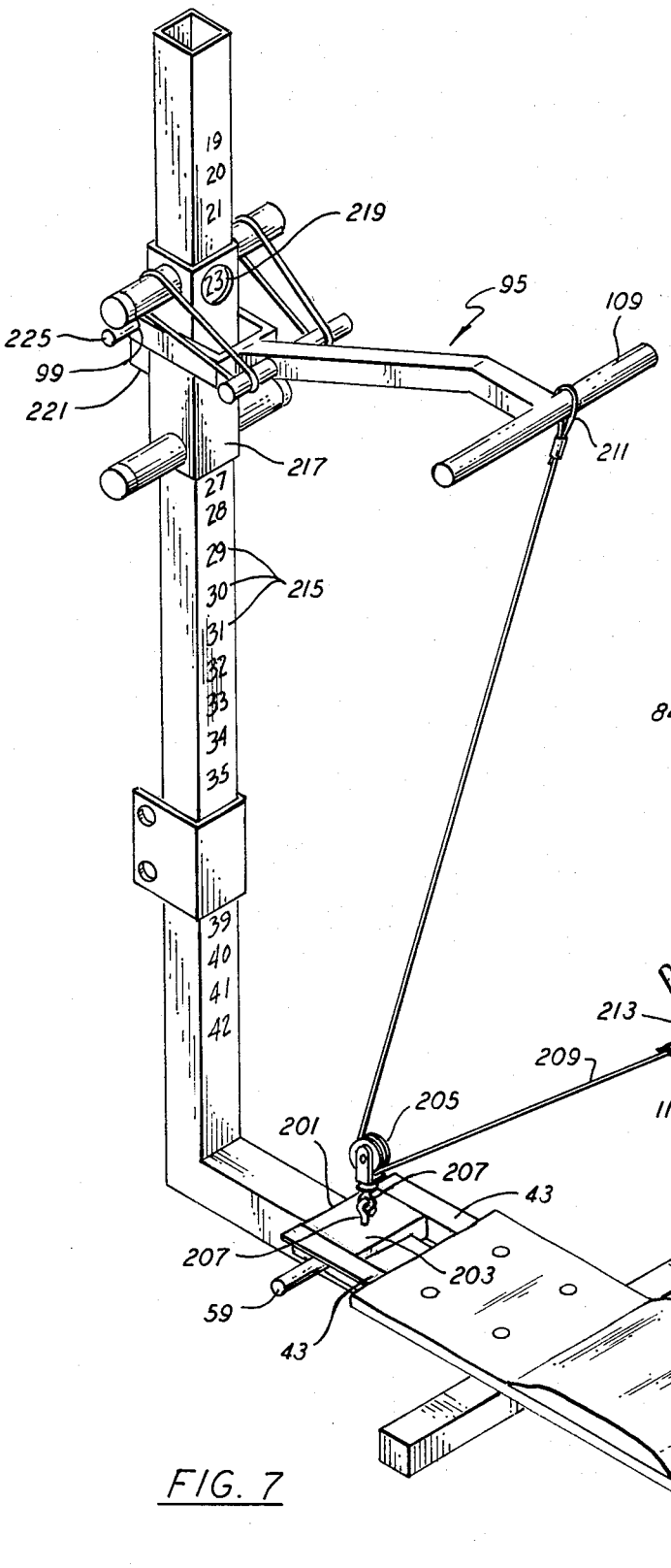
FIG. 7 is a perspective view of an embodiment of physical exercise apparatus according to the invention.

Turning to FIG. 7, a perspective view of another embodiment of exercise apparatus according to the invention is shown. In FIG. 7, only the elements described below are numbered. Unless stated otherwise, the elements in the figure are identical to those previously described in connection with other figures. In FIG. 7, bench 21 has been removed from sleeve 45 and placed astride base section 7 so that it projects over base section 5 away from column 17. As is clear from FIGS. 1 and 2, angle brackets 43 attached to the underside of bench 21 are separated by the width of sleeve 45. In FIG. 7, the space between base section 7 and brackets 43 is occupied by the arms of a cable adapter 201, having a U shape but with angled rather than curved corners, which is part of an embodiment of a cable adapting means for adapting the exercise apparatus for use as a cable-type exerciser. Adapter 201 has aligned holes (not visible) in its arms sized to receive rod 59 for attachment to base section 7. Rod 59 is inserted through bores 55 in brackets 43, the holes in adapter 201 and holes 75 in base section 7, all of which are aligned, to attach these parts together. Adapter 201 has a base 203 which is attached upwardly to base section 7 toward column 17. A pulley 205 is attached by a screw eye 207 to adapter base 203. A cable 209 having ends formed into loops 211 and 213 is threaded through pulley 205. Loop 211 is looped over handle 109. A rod, such as rod 11, is inserted through loop 213. An exerciser standing or sitting on bench 21 gripping rod 11 and pulling on cable 209 may perform exercises such as curls or rowing machine exercises, with the biasing means providing the exercising resistance and force. The function of a cable and weight exercise apparatus is thus achieved in the inventive apparatus without the use of weights.

FIG. 7 also includes a sleeve 217 which is another embodiment of sleeve 76 of FIGS. 1 and 2. Column 17 of FIG. 7 includes station numbers 215 printed on and spaced longitudinally along the column. Sleeve 217 of FIG. 7 includes a sight hole 219 located so that one of station numbers 215 is visible whenever sleeve 217 is locked in place along column 17 as previously described. The station numbers allow the user to adjust the position of the sleeve, yet repeatably return to a former position easily.

Sleeve 217 has a pair of flanges 221, only one of which is visible in FIG. 7, which contain one pair of coaxial flange bores 223, (not visible) in contrast to the pairs of such bores on sleeve 76. A cylinder 225, which may be a tube or, preferably, a rod, preferably circular in cross section, fits through the flange bores and yoke bores 99 of lever 95, to pivotally connect the lever and sleeve. No stop means such as stop means 89 of FIGS. 1 and 2 is provided. In this embodiment, it is not necessary to invert lever 95 to perform chin-ups, etc. Rather, a biasing means having a high resistance constant, e.g. 600 pounds per inch, is used. The average exerciser will cause lever 95 biased with that much resistance to move only slightly, so the necessity for inverting and stopping lever 95 is eliminated. Furthermore, in this embodiment of the apparatus the delay in removing and inverting lever 95 is eliminated so that the various sequences of an exercise routine are not interrupted and the target heart rate may be maintained.

Figure 6:
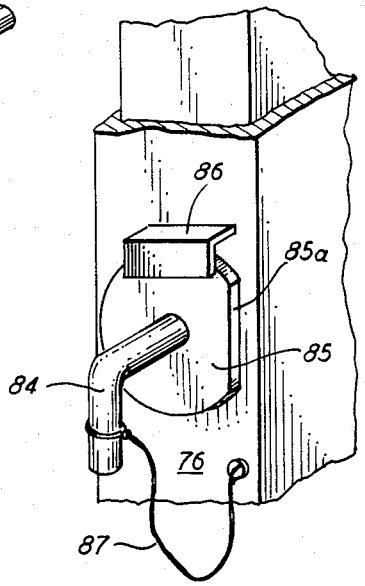
FIG. 6 is a perspective view of an embodiment of a safety means according to the invention.
Figure 8:
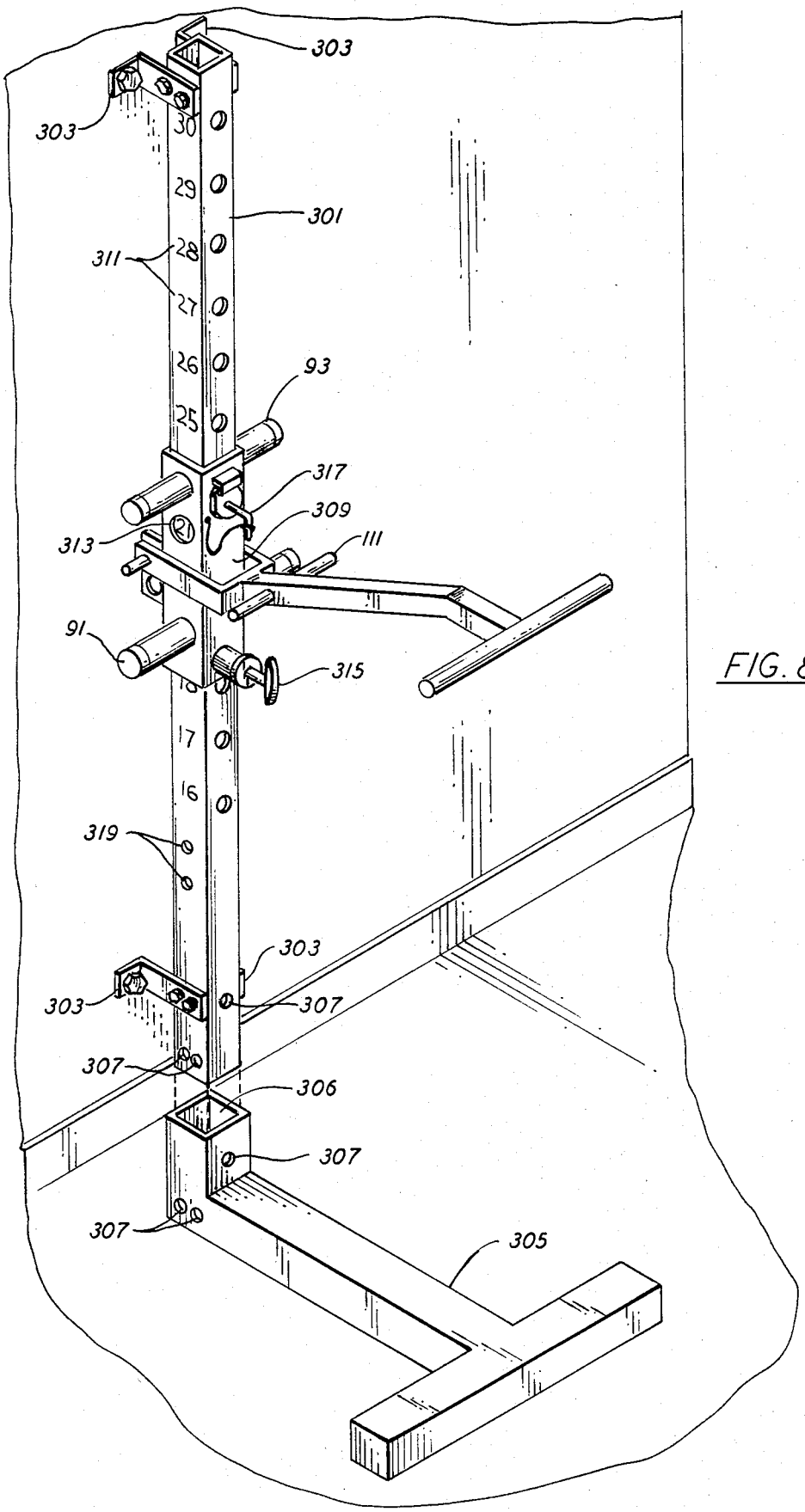
FIG. 8 is a perspective view of an embodiment of physical exercise apparatus according to the invention.

In FIG. 8, still another embodiment of apparatus according to the invention is shown. The embodiment of FIG. 8 includes a longitudinal column 301 which is mounted in a conventional manner on a wall through the use of four angle brackets 303. The brackets bolt to column 301 and to the wall. The brackets offset column 301 sufficiently from the wall so that the lever 95 can be freely pivoted. This embodiment does not need a base, but may be adapted to a floor model by the addition of a base adapter 305 as indicated by the broken lines. Base adapter 305 is formed in a T shape, like base 3 of FIG. 1, and has a longitudinal receptacle 306 into which the end of column 301 snugly fits for attachment. Holes 307 in receptacle 306 are aligned with corresponding holes 307 in column 301 for bolting the base adapter to the column. Column 301 includes a sleeve 309, essentially identical to the sleeve 217 of FIG. 7 except for the differences that are described in this paragraph. Station numbers 311 are distributed along a surface of column normal to the axis of rotation of lever 95. As a result, a sight hole 313 is located in an opposing surface of sleeve 309. A locking means, like the embodiment described in reference to FIGS. 1 and 4, is used to lock sleeve 309 into position along column 301. However, the locking means embodiment 315 shown in FIG. 8 is moved to the surface of sleeve 309 opposing bench 21 in order to be accessible. Likewise, the embodiment of a safety means, like the embodiment shown in FIGS. 1 and 6, shown as element 317 in FIG. 8, is moved to the same surface. Bench 21, which is not shown in FIG. 8, is not attached to a sleeve. Instead, one of a plurality of pairs of coaxial bores 319 in column 301 receives a key 57 which passes through bores 55 in brackets 43 to connect bench 21 to column 301. Obviously, the position of the bench may be adjusted by selecting different bores 319 for alignment with those of brackets 43. The bench is removed as previously described. The other end of bench 21 is supported by conventional support means such as legs or a U-frame fixedly attached to the underside of the bench.

Figure 9:
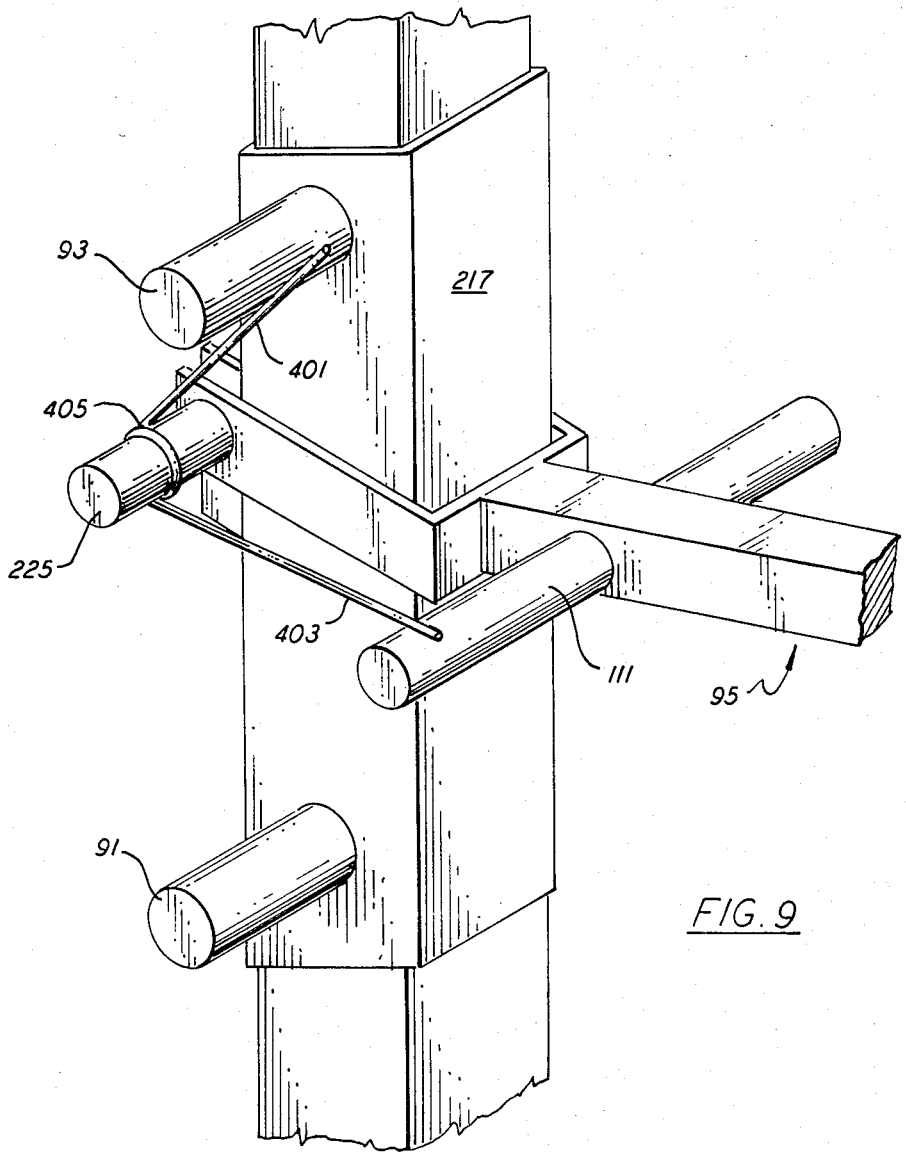
FIG. 9 is a perspective view of a portion of an embodiment of physical exercise apparatus according to the invention showing an alternative embodiment of a biasing means.

In FIG. 9, another embodiment of a biasing means is shown installed on sleeve, such as sleeve 217 of FIG. 7. In this embodiment, rod 225, which is an embodiment of the pivoting means previously described, has no T handle. Rod 225 projects beyond the transverse dimensions of sleeve 217. The embodiment of the biasing means comprises first and second coil arms 401 and 403 extending from a helical coil 405. Preferably, the coil and arms are formed from a single spring steel member appropriately tempered. Coil 405 is secured to rod 225 by slipping it over one end of rod 225. Coil arms 401 and 403 are secured to the securing means by friction. To install the biasing means, pressure is placed on coil arms 401 and 403 bringing them slightly closer together so that they may be slipped into contact with the securing means. This embodiment of a biasing means bears on one of cylinders 111 on lever arm 95 and one of cylinders 91 or 93 on sleeve 217, depending on the direction in which lever arm 95 is to be biased. The coil embodiment biasing means provides a torsional resistance to the movement of lever arm 95 in the direction selected for exercise. As lever 95 is operated, the coil arms resist displacement by the torsional reaction force produced by coil 405. The coils are preferably mounted in matched pairs on opposite sides of column 17 to provide balanced exercising force resistance. More than one coil may be mounted on each side of column 17 to increase the exercising force resistance.

Regardless of which of the set-ups of FIGS. 1, 2, 3, 7, 8 or 9 are used, with the present apparatus employing a lever pivoted on two flanges mounted on a sleeve, a force applied to handle 109 will produce a moment force on sleeve 76, 217 or 309 causing it to rotate. The rotation is limited by the bearings between the sleeve and column and the rotational force is borne by the bearings and/or transverse edges on column 17 or 301. That is, the applied stress will be distributed and relieved by column 17 or 301 rather than being applied and concentrated at the pivot of lever 95 or on longitudinal flanges 77 and 78 or 221. Moreover, when biasing means are used, as shown in FIGS. 1, 3, 7 and 9, the stresses where arm 103 joins yoke 101 are reduced in comparison to other devices because the biasing means attachment point is spaced from that junction. When biasing means are not used, as in FIG. 2, the moment is applied to stop 89 and throughout lever 95 without the concentration at the junction of yoke 101 and arm 103 which would occur if arm 103 were restrained at that junction.

The invention has been described with reference to certain preferred embodiments. As will be appreciated by those with skill in the art, various modifications, substitutions and additions may be made without departing from the spirit of the invention. Therefore, the scope of the invention is limited solely by the following claims.

I claim:

1. Apparatus for physical exercise comprising:

a longitudinal column, a first sleeve slidably engaging said column, said sleeve including first securing means for securing a biasing means to said sleeve, first locking means for locking said first sleeve at a selected position along said column, a lever transversely, pivotally connected to said first sleeve, said lever comprising: a yoke straddling said first sleeve and containing coaxial transverse yoke bores; an arm joined to said yoke centrally; and second securing means joined to said arm for securing a biasing means to said arm, pivot means passing through said yoke bores and said first sleeve for pivotally connecting said first sleeve and said lever, biasing means securable to said first and second securing means for providing resistance to pivotal movement of said lever, wherein said pivot means comprises a cylinder extending through said yoke bores and said biasing means comprises a helical coil encircling said cylinder, said coil having first and second coil arms for bearing on said first and second securing means, respectively.

2. The apparatus of claims 1 or 5 wherein said first and second securing means comprise opposing transverse cylinders.

3. The apparatus of claim 2 wherein said first securing means comprises opposing transverse cylinders disposed at opposing longitudinal ends of said first sleeve.

4. Apparatus for physical exercise comprising:

a longitudinal column, a first sleeve slidably engaging said column, said sleeve including first securing means for securing a biasing means to said sleeve, first locking means for locking said first sleeve at a selected position along said column, a lever transversely, pivotally connected to said first sleeve, said lever comprising: a yoke straddling said first sleeve and containing coaxial transverse yoke bores; an arm joined to said yoke centrally; and second securing means joined to said arm at a location spaced from the junction of said arm and said yoke for securing a biasing means to said arm, wherein said first sleeve includes two longitudinal flanges each containing a transverse flange bore, said flange bores being coaxial, said yoke and flange bores being mutually alignable, and further including pivot means passing through said aligned yoke and flange bores for pivotally connecting said first sleeve and said lever, and biasing means securable to said first and second securing means for providing resistance to pivotal movement of said lever.

5. The apparatus of claim 4 wherein said biasing means comprises endless elastic cords.

6. Apparatus for physical exercise comprising:

a longitudinal column, a first sleeve slidably engaging said column, said sleeve including first securing means for securing a biasing means to said sleeve, first locking means for locking said first sleeve at a selected position along said column, a lever transversely, pivotally connected to said first sleeve, said lever comprising: a yoke straddling said first sleeve and containing coaxial transverse yoke bores; an arm joined to said yoke centrally; and second securing means joined to said arm at a location spaced from the junction of said arm and said yoke for securing a biasing means to said arm, wherein said first sleeve includes two longitudinal flanges each containing a transverse flange bore, said flange bores being coaxial, said yoke and flange bores being mutually alignable, and further including pivot means passing through said aligned yoke and flange bores for pivotally connecting said first sleeve and said lever, a transverse base attached to said column, a transverse bench disposed above said base and having first and second opposing ends, support means attachable to said base and pivotally connected to said first end of said bench for supporting said bench, a second sleeve slidably engaging said column and pivotally attached to said second end of said bench, and second locking means for locking said second sleeve at a selected position along said column.

7. The apparatus of claim 6 wherein said second locking means comprises a plurality of longitudinally aligned apertures in said column, an aperture in said second sleeve alignable said apertures in said column, and pin means for engaging aligned apertures in said second sleeve and said column.

8. The apparatus of claim 7 wherein said pin means further comprises a pin and urging means for urging said pin into said apertures.

* * * * *